US012030114B2

(12) United States Patent
Wilson et al.

(10) Patent No.: US 12,030,114 B2
(45) Date of Patent: Jul. 9, 2024

(54) METHOD OF CONTROLLING THE SHAPE OF AN INGOT HEAD

(71) Applicant: NOVELIS INC., Atlanta, GA (US)

(72) Inventors: Phillip Wilson, Kennesaw, GA (US); John Robert Buster McCallum, Kennesaw, GA (US); Aaron David Sinden, Kennesaw, GA (US); Brent Opdendries, Post Falls, ID (US); Jason Dell Hymas, Kennesaw, GA (US); Todd F. Bischoff, Kennesaw, GA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 17/907,161

(22) PCT Filed: Mar. 25, 2021

(86) PCT No.: PCT/US2021/024152
§ 371 (c)(1),
(2) Date: Sep. 23, 2022

(87) PCT Pub. No.: WO2021/195379
PCT Pub. Date: Sep. 30, 2021

(65) Prior Publication Data

US 2023/0105627 A1 Apr. 6, 2023

Related U.S. Application Data

(60) Provisional application No. 63/000,058, filed on Mar. 26, 2020.

(51) Int. Cl.
*B22D 11/049* (2006.01)
*B22D 11/00* (2006.01)
(Continued)

(52) U.S. Cl.
CPC ..... *B22D 11/049* (2013.01); *B22D 11/003* (2013.01); *B22D 11/112* (2013.01); *B22D 11/22* (2013.01)

(58) Field of Classification Search
CPC ..... B22D 11/00; B22D 11/003; B22D 11/049; B22D 11/10; B22D 11/112; B22D 11/22
(Continued)

(56) References Cited

U.S. PATENT DOCUMENTS 4,415,017 A 11/1983 Yarwood et al.
4,789,021 A 12/1988 Ahrens
(Continued)

FOREIGN PATENT DOCUMENTS

CH 676 211 A5 * 12/1990 ..... B22D 11/04
CN 101835551 A 9/2010
(Continued)

OTHER PUBLICATIONS

PCT/US2021/024152 , "International Search Report and Written Opinion", Jun. 2, 2021, 12 pages.
(Continued)

*Primary Examiner* — Kevin P Kerns
(74) *Attorney, Agent, or Firm* — Kilpatrick Townsend & Stockton LLP

(57) ABSTRACT

Systems and associated methods are provided for controlling the shape of an ingot head during formation. At the end of a cast, prior to forming the ingot head, chill bars or other cooling structure may be lowered into an ingot mold and define a reduced casting footprint for forming the ingot head. Supplemental molten metal may be fed into the reduced casting footprint, and the chill bars may be moved laterally towards the center of the ingot, further reducing the casting footprint. As additional molten metal fills the reduced mold footprint, the ingot may be lowered relative to the chill bars
(Continued)

to further increase the height of the ingot head. Additional molten metal may be added until the desired shape of the ingot head is formed.

22 Claims, 13 Drawing Sheets

(51) Int. Cl.
*B22D 11/112* (2006.01)
*B22D 11/22* (2006.01)

(58) Field of Classification Search
USPC ..... 164/444, 418, 425, 426, 445, 446, 486, 164/487
See application file for complete search history.

(56) References Cited

U.S. PATENT DOCUMENTS

| | | | |
|---|---|---|---|
| 8,561,669 | B2 | 10/2013 | Naess, Jr. et al. |
| 9,545,662 | B2 | 1/2017 | Anderson et al. |
| 10,350,674 | B2 | 7/2019 | Cordill et al. |

FOREIGN PATENT DOCUMENTS

| | | | |
|---|---|---|---|
| CN | 103260794 | A | 8/2013 |
| CN | 106825469 | A | 6/2017 |
| EP | 0812638 | A1 | 12/1997 |
| FR | 2526340 | A1 | 11/1983 |
| JP | 2002001494 | A | 1/2002 |
| JP | 2009148836 | A | 7/2009 |
| JP | 2010536578 | A | 12/2010 |
| RU | 1799675 | A1 | 3/1993 |
| SU | 1079347 | A1 | 3/1984 |
| SU | 1336943 | A3 | 9/1987 |

OTHER PUBLICATIONS

PCT/US2021/024152 , "International Preliminary Report on Patentability", Oct. 6, 2022, 9 pages.
RU2022125197 , "Office Action", Mar. 16, 2023, 15 pages.
RU2022125197 , "Notice of Decision to Grant", Jun. 2, 2023, 21 pages.
CA3,169,621 , "Office Action", Aug. 18, 2023, 4 pages.
EP21722007.8 , "Office Action", Aug. 24, 2023, 4 pages.
Japanese Patent Application No. JP2022-556665, Office Action mailed Oct. 3, 2023, 5 pages.
JP2022-556665, "Office Action", Jan. 23, 2024, 5 pages.
KR10-2022-7028685, "Office Action", Oct. 24, 2023, 11 pages.
CN202180023648.9, "Office Action", Mar. 23, 2024, 18 pages.

* cited by examiner

METHOD OF CONTROLLING THE SHAPE OF AN INGOT HEAD

CROSS-REFERENCE TO RELATED APPLICATION

This application is the US National Stage of International Application No. PCT/US2021/024152, filed Mar. 25, 2021, which claims the benefit of and priority to U.S. Provisional Application No. 63/000,058, filed on Mar. 26, 2020, and titled "METHOD OF CONTROLLING THE SHAPE OF AN INGOT HEAD," the content of which is herein incorporated by reference in its entirety for all purposes.

FIELD

The present disclosure relates to metal casting generally and more specifically to controlling the shape of an ingot head in a direct chill cast.

BACKGROUND

Direct chill casting is a process of casting molten metal in a mold with a movable bottom. Direct chill casting uses cooling to solidify flowing molten metal from the outside of the metal sump inwards. The ingot is lengthened by lowering the movable bottom as additional molten metal fills the mold.

When forming ingots, as the end of the casting process is reached, the flow of molten metal halts and the ingot head cools to a solid. As the flow of molten metal halts (e.g., and as the molten metal solidifies in the sump), a shrinkage cavity may form in the ingot head. The shrinkage cavity may not always form a consistent shape and often varies due to the bulk of material that may cool at uneven rates, causing varying internal stresses in the ingot head.

As the shrinkage cavity forms, significant resulting internal stresses can occur, which can cause the ingot head to crack and open up, rendering the end of the ingot as wasted, unusable material. This phenomenon can be particularly noticed during metal processing, such as in a rolling mill, where such cracking or opening can result in significant material loss.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Certain examples herein pertain to systems and/or methods of controlling the shape of an ingot head. While the shape of the ingot forming during a cast may be initially defined by a casting footprint bounded by the mold, the head of the ingot near the end of the cast may be defined by a reduced casting footprint that is bounded by a cooling assembly, such as, but not limited to a chill bar assembly, rather than the mold. The cooling assembly includes one or more components (e.g., cooling structures such as chill bars) that can be lowered along the mold into a position from which progressive lateral movement can be imparted to further reduce the casting footprint, such as to provide a resulting ingot head shape (e.g., a tapered shape) that may avoid issues associated with shrinkage cavities or otherwise provide benefits for subsequent processing of the ingot.

In some embodiments, a method for forming an ingot is provided. The method can include feeding molten metal into a mold to form a base of an ingot. As the ingot forms, moving a cooling structure, such as a chill bar, towards the molten metal in the ingot. After the cooling structure has contacted the molten metal, the cooling structure may be moved laterally such that additional molten metal is bounded by the cooling structure. Supplemental molten metal may then be added to the area bounded by the cooling structure to form the ingot head.

In some embodiments, a system for forming an ingot is provided. The system can include a mold, a movable bottom, a nozzle, and a cooling assembly. The mold may be suitable for receiving molten metal and define a casting footprint of the ingot. The movable bottom may be movable in the vertical direction. The nozzle may be positioned above the mold and suitable for feeding molten metal into the mold. The cooling assembly may have a cooling structure and an actuator. The actuator may actuate the cooling structure in a lateral direction to create a smaller casting footprint bounded by the cooling structure.

In some embodiments, a chill bar assembly is provided. The chill bar assembly can include a chill bar, a coolant conduit, and an angle adjustment base. The chill bar may be movable in a vertical direction and suited for engaging with a molten metal surface. The coolant conduit may carry heat away from the chill bar as coolant runs through the conduit. The angle adjustment base may orient the chill bars among predetermined angles.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

The following examples will serve to further illustrate the present disclosure without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the disclosure.

While certain aspects of the present disclosure may be suitable for use with any type of material, such as metal, certain aspects of the present disclosure may be especially suitable for use with aluminum or aluminum alloys.

Systems and/or methods may be implemented for controlling the shape of an ingot head (e.g., the uppermost portion of the ingot once cast) during metal processing. As an ingot approaches the end of a cast, cooling structures (such as chill bars) may be lowered to interface with the top of the ingot. Molten metal can continue to be fed to form the head of the ingot as the chill bars move laterally inwards. The positioning of the chill bars relative to the mold can form a reduced casting footprint into which molten metal flows, reducing the volume of molten metal cooling as the head forms. Due to the reduced casting footprint, the volume of molten metal cooling decreases, which may mitigate the internal stresses that might otherwise be caused by a shrinkage cavity. Although the examples provided in this application involve the use of chill bars, any other suitable cooling structure alternatively or additionally, such as secondary mold walls, could be used to reduce the casting footprint toward the end of the cast.

Figure 1:
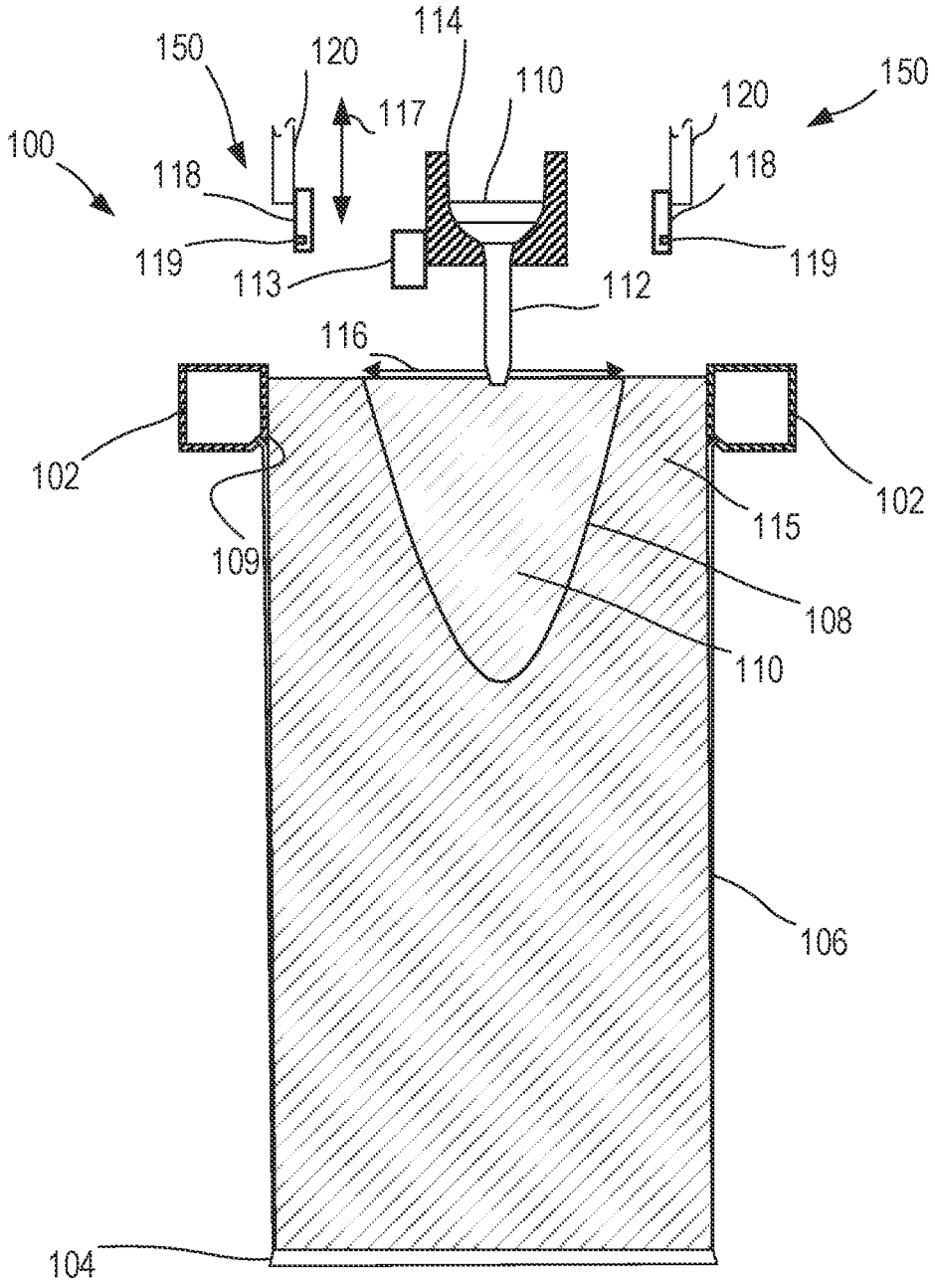
FIG. 1 is a cross-sectional side view of a system for shaping an ingot head, according to various embodiments.

FIG. 1 depicts a system 100 for controlling the shape of an ingot head, according to embodiments. System 100 includes a mold 102, a movable bottom 104, a molten metal source 112, and a metal level sensor 113. System 100 also includes a cooling assembly, which is in the form of a chill bar assembly 150 in FIG. 1.

The mold 102 may receive molten metal 110 into one or more mold openings. The molten metal 110 may be contained and formed into a shape by the mold 102 as the molten metal 110 cools and solidifies. In various embodiments, mold 102 may be rectangular with four side walls, although other shapes and/or numbers of side walls may be utilized. In some embodiments, two opposing sidewalls may be straight and two opposing sidewalls may be contoured (such as approximated by the dashed lines 201A in FIGS. 2A and 2B, for example). Contoured sidewalls in the mold 102 may provide dimensional stability in an ingot 106 produced by the mold. For example, although contoured sidewalls may impart an initial curvature to opposite edges of the ingot 106, continued cooling and solidifying of the molten metal 110 may lead to shrinkage that may at least partially flatten the pre-curved edges of the ingot 106 toward a rectangular profile that may be useful for subsequent processing of the ingot 106. The mold 102 can include an open top for receiving molten metal 110. In alternative embodiments, the mold 102 can be any type and shape suitable for casting molten metal 110. On an opposite end, the mold 102 can include an open bottom through which the solidified metal of ingot 106 may exit and be lowered by the movable bottom 104. The open bottom may be bounded at least in part by a tang 109, which may be utilized as a reference for a metal-level of zero within the mold 102. For example, points measured above the tang 109 may be represented by a positive value whereas points measured below the tang 109 may be represented by a negative value. The side walls of mold 102 and/or movable bottom 104 can define an initial casting footprint for the size and shape of the ingot 106.

The mold 102 may be associated with movable bottom 104 for forming ingot 106 during direct chill casting. In some embodiments, movable bottom 104 may be a starting head mounted on a telescoping hydraulic table.

The mold 102 may aid in the cooling of the molten metal 110. For example, mold 102 can be water-cooled. Mold 102 can also include a cooling system that uses one or more of air, glycol, or any suitable cooling medium.

The molten metal source 112 can provide molten metal 110 to the mold 102. To this end, the molten metal source 112 can be positioned adjacent to the mold 102. The molten metal source 112 can include suitable structure for dispensing the molten metal 110 into mold 102. For example, the molten metal source 112 may include or be associated with a launder 114 and/or a feed tube. The launder 114, feed tube, or other structure of the molten metal source 112 may contain one or more openings through which molten metal 110 may be dispensed. In various embodiments, the molten metal source 112 may be positioned above the mold 102 and deposit molten metal 110 into the mold 102 (e.g., into an open space defined by the mold 102) from the one or more openings. Molten metal source 112 can be any size and shape suitable for containing and dispensing molten metal 110. As shown in FIG. 1, launder 114 can have a rectangular shape with a U-shaped channel for containing molten metal 110 and be connected to a feed tube that is generally cylindrical, although other shapes and/or profiles may be utilized. In embodiments, molten metal source 112 may regulate the flow of molten metal 110 by a valve, a stop, control pin, funnel, or otherwise.

Metal level sensor 113 may detect the level of metal within mold 102. Metal level sensor 113 may be capable of detecting a level of molten or solidified metal. Non-limiting options for the metal level sensor 113 may include a float and transducer, a laser sensor, or another type of fixed or movable fluid level sensor having desired properties for accommodating or detecting a level of molten metal relative to the mold. Metal level sensor 113 may provide feedback to molten metal source 112 to regulate the flow of molten metal 110.

In operation, the ingot 106 can be formed as molten metal 110 cools and solidifies. For example, prior to depositing molten metal 110 into the mold 102, the movable bottom 104 may be lifted to meet the mold 102. Molten metal 110 is deposited into the mold 102 and begins to cool, forming solidifying metal 115. As the solidifying metal 115 begins to form within the mold 102, the movable bottom 104 can be steadily lowered. The solidifying metal 115 forms a casing around the molten metal 110 (sometimes referred to as a molten metal sump). As molten metal 110 is added to the top of the mold 102, the movable bottom 104 can continue to lower, continuously lengthening the solidifying metal 115. Thus, as movable bottom 104 lowers, the height of ingot 106 increases. As molten metal 110 cools over time, solidifying interface 108, which marks the boundary between solidified metal 115 of ingot 106 and fed molten metal 110, moves inwards towards the center. Molten metal 110 can spread across the top of the ingot 106 along the lateral direction 116.

Ingot 106 may be formed from any metal or combination of metals capable of being heated to a melting temperature. In a non-limiting example, the metal used in ingot 106 includes aluminum or aluminum alloys. Additionally or alternatively, the metal used to form ingot 106 can also include iron, magnesium, or a combination of metals and metallic alloys.

Figure 7:
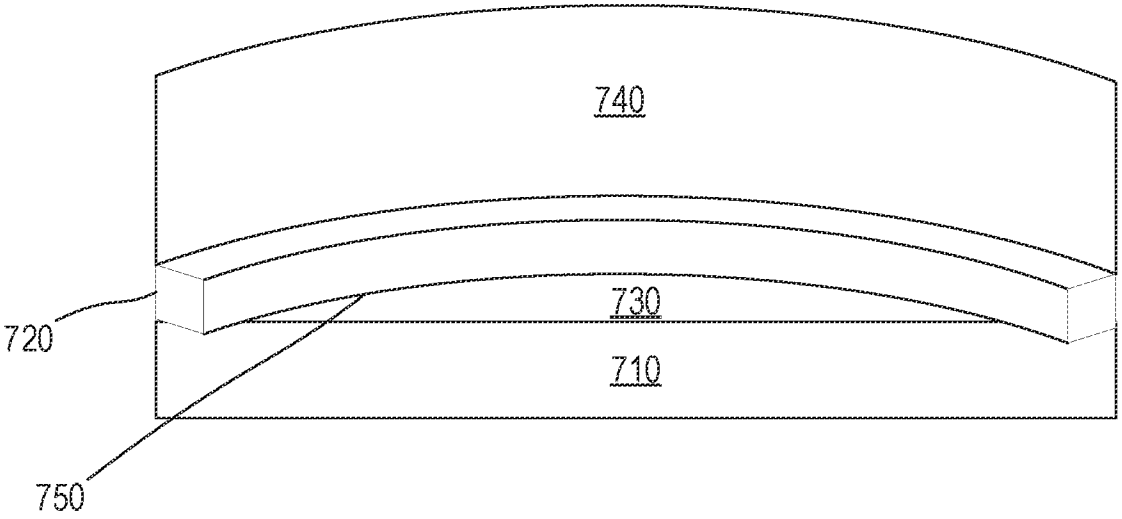
FIG. 7 is a side-view of a rectangular chill-bar in a contoured mold, according to various embodiments.

As noted previously, the system 100 includes one or more chill bar assemblies 150. Chill bar assembly 150 shown in FIG. 1 is movable and includes a cooling structure, such as chill bar 118, and a vertical actuator 120. Chill bar 118 may be cooled by water or any other suitable coolant running through the chill bar 118. The chill bar 118 can be shaped to conform to the profile of the mold 102. In conforming to the profile of the mold 102, the chill bar 118 can have a straight, bent, curved, or angled profile. Some examples of shaped chill bars 118 are discussed in greater detail below with respect to other figures, such as having a triangular cross-section as discussed below with respect to FIG. 4 and/or having a curved profile as discussed below with respect to FIG. 7. Vertical actuator 120 positions the chill bar assembly 150 among suitable vertical positions along the vertical direction 117, including a raised position and a lowered position. For example, the chill bar 118 in the raised position may be located above the mold 102 (e.g., within a vertical projection of the region bounded by the mold 102) while ingot 106 is being formed. As ingot 106 nears completion of cast, the vertical actuator 120 may lower the chill bar 118 into the lowered position to be within the mold 102 and proximate a solidifying end of ingot 106 (e.g., a top of ingot 106 at that point in the cast). In embodiments, vertical actuator 120 may be a pneumatic cylinder, although any other suitable positioning actuator may be utilized.

Chill bar 118 may be configured to narrow and constrain an end of the ingot 106 when in the lowered position. In the lowered position, as described in more detail below, the chill bar 118 is positioned inside the inner walls of the mold and thus reduces the size of the mold opening. For example, whereas an initial casting footprint of the ingot is defined by the mold 102, when chill bar 118 is in the lowered position, a reduced casting footprint of the ingot is defined at least partially by the chill bar 118. The reduced casting footprint is smaller than the initial casting footprint as defined by the mold 102.

In use, chill bar 118 also may be movable in the lateral direction 116 (such as by structures described with respect to subsequent figures herein) between and an initial positioned and subsequent, narrower positions. As chill bar 118 moves laterally inwardly, the reduced casting footprint defined by chill bar 118 may become progressively smaller and smaller than the initial casting footprint as defined by the mold 102. In some embodiments, the rate at which the chill bar 118 moves laterally can be variable. In embodiments, chill bar 118 may already be in a lowered position inside the inner walls of mold 102, and thus, the initial movement of chill bar 118 would be in the lateral direction. In embodiments, chill bar 118 may be a skim bar that is within the melt during casting the body of the ingot 106, and moves inwards as the head of the ingot 106 begins forming to control the shape of the head of ingot 106.

In some examples, the chill bar 118 may include, may be coupled with, or may otherwise be outfitted with a coolant jet 119. Although discussion herein primarily refers to the coolant as water, any other suitable form of coolant may be utilized. As the chill bar 118 moves laterally inward in direction 116, the coolant jet 119 may be employed to assist in cooling with a shell of the head of the ingot 106. In embodiments, the coolant jet 119 may be configured to disperse water or other coolant in a continuous stream, at variable flow rates, or discontinuous as a sprinkler-type jet. In some embodiments, the chill bar assembly 150 does not include the coolant jet 119.

Figure 2A:
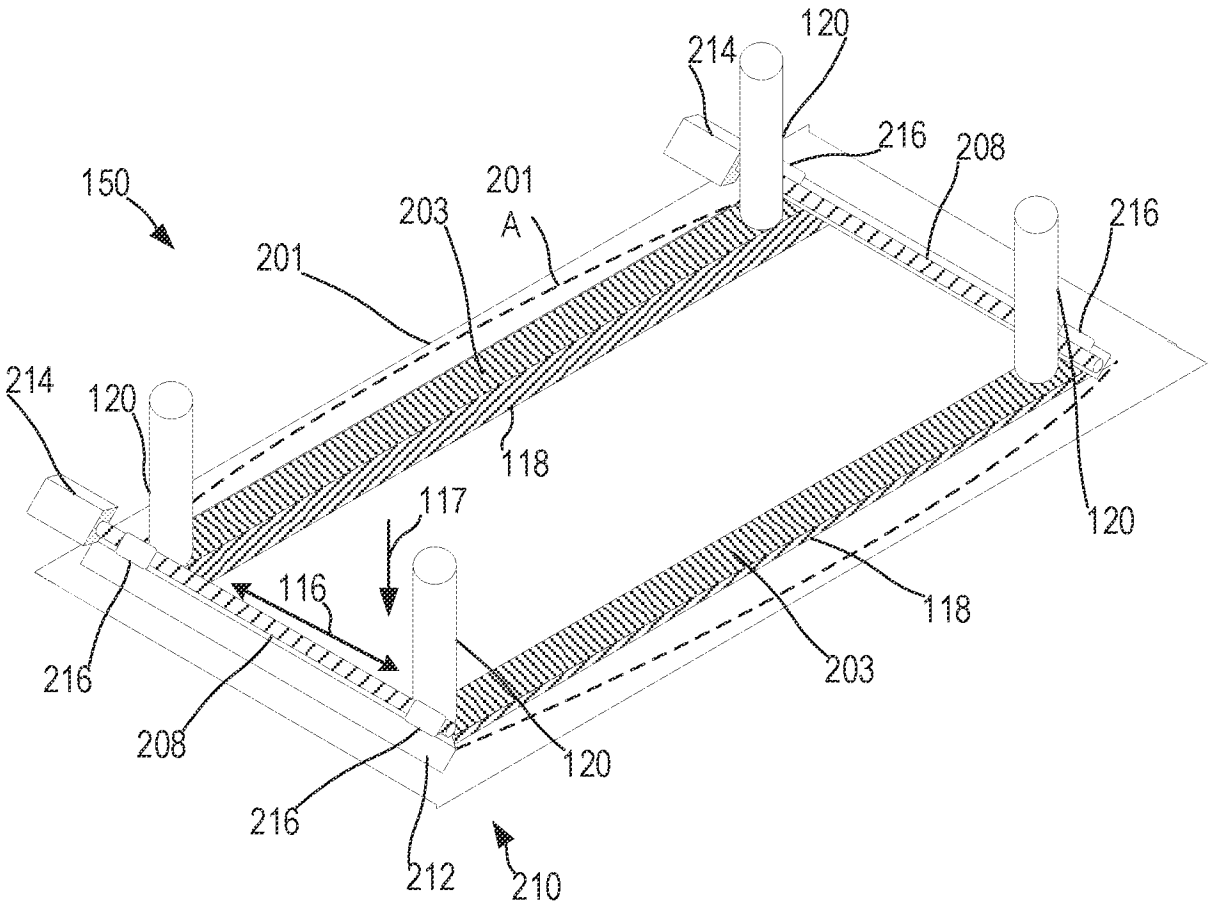
FIG. 2A is a perspective view of a chill bar assembly with elements in a first position relative to a mold, according to various embodiments.
Figure 2B:
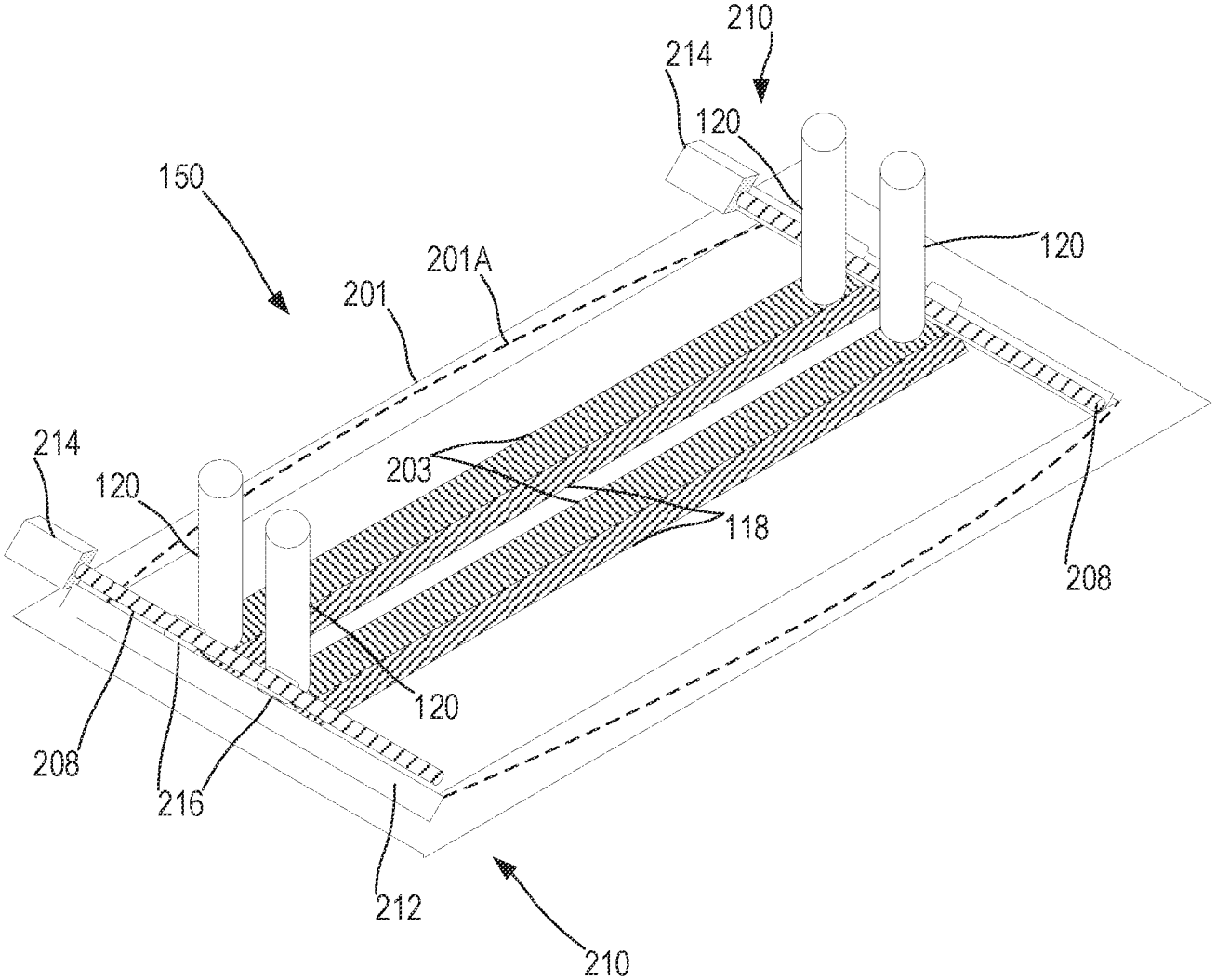
FIG. 2B is a perspective view of the chill bar assembly of FIG. 2A with elements in a second position relative to the mold, according to various embodiments.

FIGS. 2A and 2B show perspective views of chill bar assembly 150, according to some embodiments. Chill bar assembly 150 of FIGS. 2A and 2B may be the same chill bar assembly of FIG. 1, although it need not be. In addition to some components already discussed with respect to FIG. 1, chill bar assembly 150 as depicted in FIG. 2 includes various other components, including a frame 201, crossbars 203, a lateral actuator 210, guiderail 212, and a support bracket 216, although other components or combinations of components may additionally or alternatively be utilized.

Frame 201 can correspond to any suitable structure that may support and/or orient elements of the chill bar assembly 150 relative to one another. The frame 201 may be positioned over or along a top side of the mold 102. The frame 201 may correspond to a portion of the mold 102 or may correspond to a separate component coupled with or positioned relative to the mold 102. The frame 201 may match a contour of the mold 102. For example, although the frame 201 is shown with straight edges in solid lines in FIGS. 2A and 2B, the frame 201 may alternatively include one or more curved edges, such as depicted by the dashed lines 201A in FIGS. 2A and 2B by way of example.

Crossbars 203 may support or otherwise be coupled with chill bar 118, and/or lateral actuator 210. Crossbar 203 may optionally house a coolant, such as water, glycerol, oil, etc., for chill bar 118. Guiderail 212 may provide structural support across frame 201.

While FIGS. 2A and 2B show crossbar 203 supporting vertical actuator 120 (e.g., with vertical actuator 120 atop crossbar 203), other configurations may be used. In some embodiments, crossbar 203 may be at least partially supported by vertical actuator 120. For example, vertical actuator 120 may be mated or mounted relative to frame 201, e.g., such that, as crossbar 203 moves inwardly towards the center of the mold 102, vertical actuator 120 remains stationary or in place relative to frame 201.

In embodiments, lateral actuator 210 may include or otherwise utilize a servo motor 214 and ball screw 208. In such a configuration, turning the ball screw 208 may result in opposite portions of the chill bar assembly 150 moving by equal amounts toward or away from each other along the lateral direction 116. For example, the ball screw 208 may be threaded in opposing directions at opposite ends (e.g., diverting or switching from center) so that turning the ball screw 208 causes such synchronized movement of the chill bar 118 along lateral direction 116. The ball screw 208 may be turned by, for example, a shaft, a driver, or other structure driven by servo motor 214. Additionally or alternatively, any other suitable type of actuator capable of imparting lateral movement may be used. Lateral actuator 210 may utilize alternative structure in place of ball screw 208 to cause the synchronized movement of the chill bar 118 as described above.

Support bracket 216 may secure chill bar 118 to the ball screw 208, such as by fasteners like screws, bolts, or otherwise. In embodiments where an alternative actuator to impart lateral movement is used, such as with a movable arm actuated in a lateral direction 116 by a motor, support bracket 216 may similarly secure chill bar 118 to lateral actuator 210.

FIG. 2A shows chill bar assembly 150 in the initial position, while FIG. 2B shows chill bar assembly 150 in a second position after chill bar 118 has been moved along the lateral direction 116 (e.g., inwardly towards the center of mold 102). In FIGS. 2A-2B, ball screw 208 is threaded, although any structure capable of changing the lateral position of chill bars 118 may be utilized, such as use of a non-threaded guiderail, positioning plates, or otherwise.

In embodiments, lateral actuator 210 may operate based at least in part on input from a sensor, which may be metal level sensor 113. The sensor may be capable of detecting a fill level of molten metal 110. For example, in response to an indication from the sensor that a desired molten metal level has been reached (or solidified or frozen), the lateral actuator 210 may be actuated to move chill bars 118 along lateral direction 116 to another position, such as inwardly toward the center of the mold 102 to further reduce a size of the casting footprint and/or otherwise alter a shape of the head of the ingot 106.

FIGS. 3A through 3E show select elements of system 100 at different stages throughout an exemplary process of controlling the shape of the ingot 106 (e.g., the shape of the head of the ingot 106).

Figure 3A:
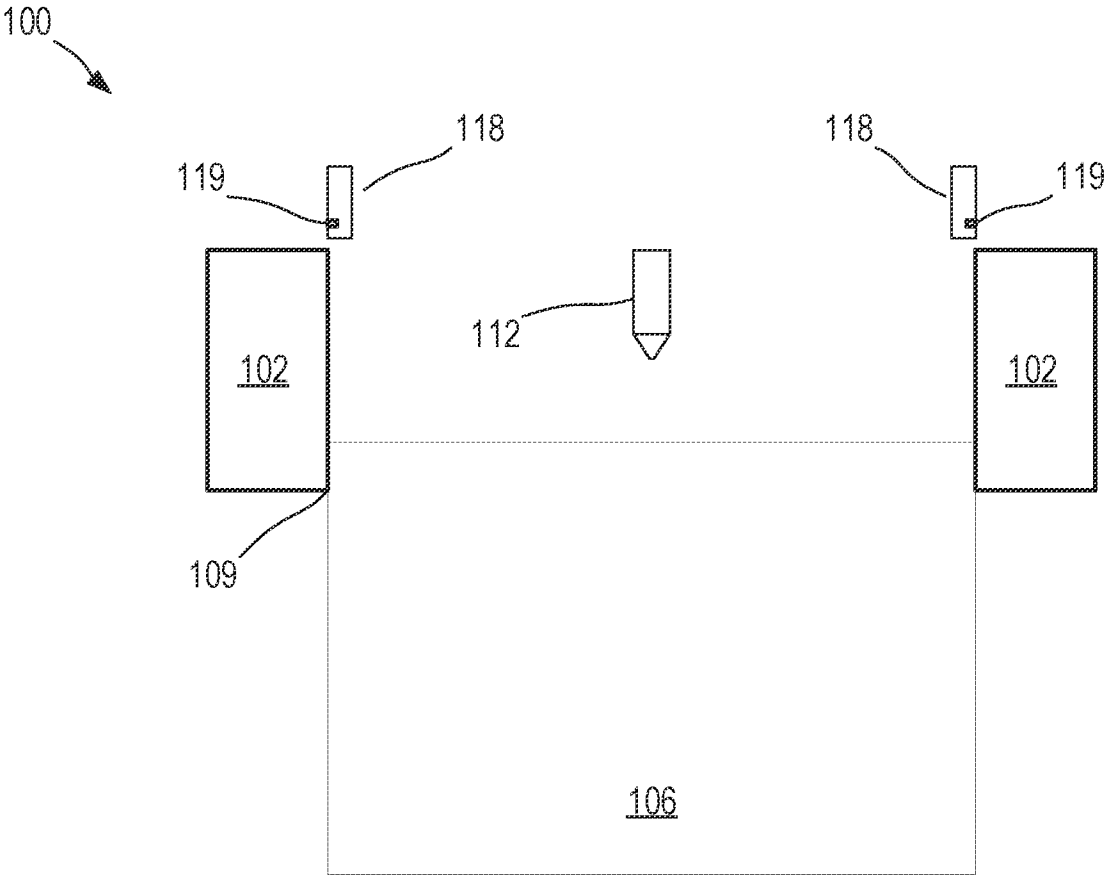
FIGS. 3A through 3E are side views respectively showing different states of elements of a system during an example of a process of shaping an ingot head, according to various embodiments.

In FIG. 3A, ingot 106 has neared the end of a casting process, where ingot 106 has reached a desired length, and is ready for formation of the ingot head. Chill bars 118 are in a raised, initial position above the mold 102. Molten metal source 112 has finished supplying a first amount of molten metal to form a base of the ingot 106, with the metal level above the tang 109.

Figure 3B:
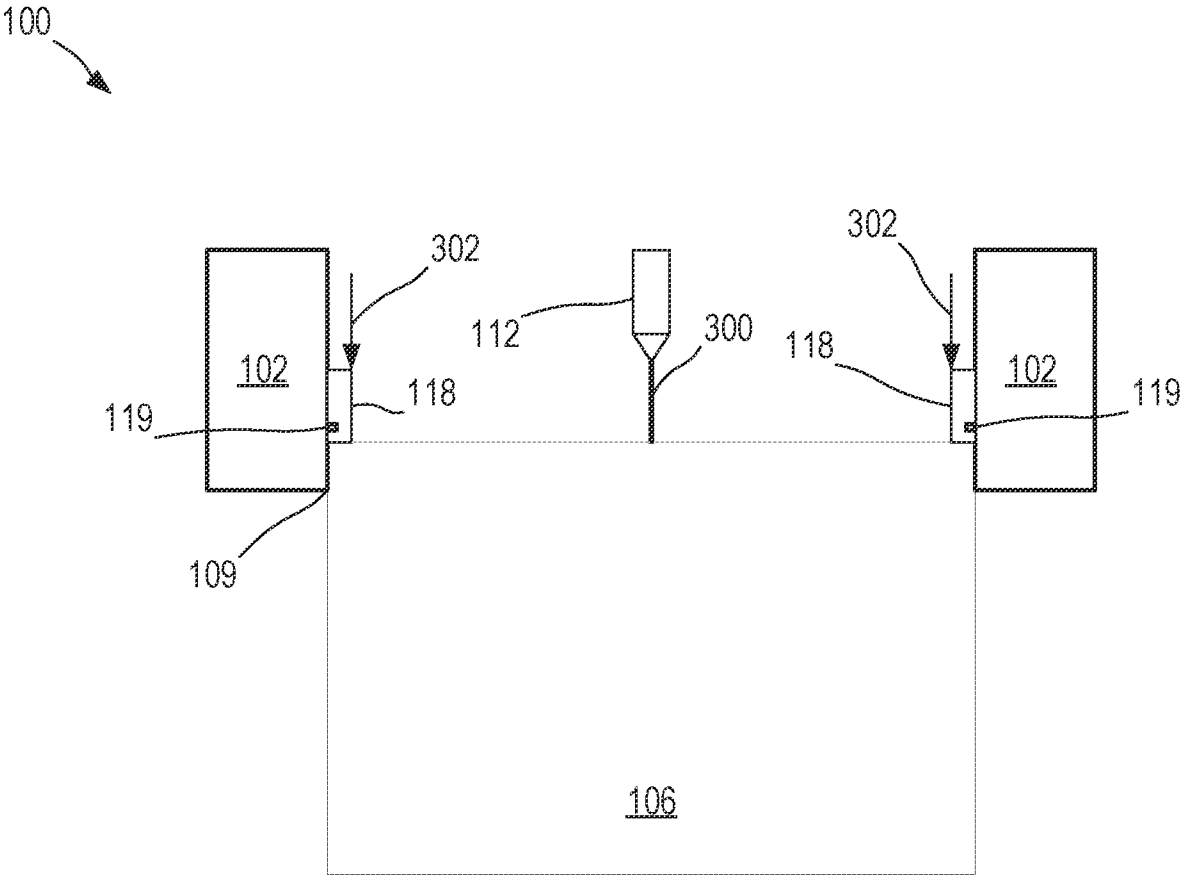

In FIG. 3B, chill bars 118 have been lowered into the lowered position so they are in in contact with or above a top surface of ingot 106, and within the mold 102, forming a reduced casting footprint for the remaining ingot to be cast. In some embodiments, the chill bars 118 can be lowered such that the end of the chill bar is below the surface of the molten metal. For example, the chill bars 118 have been lowered (e.g., along vertical direction 302) to the lowered position by actuators (such as vertical actuator 120, e.g., FIGS. 1, 2A, 2B) into a position above the tang 109. Once the chill bars 118 have been lowered into the lowered position, molten metal source 112 can begin supplying supplemental molten metal 300 into the reduced mold footprint defined by chill bars 118. As supplemental molten metal 300 spreads along the reduced mold footprint, chill bars 118 may gradually cause solidification or freezing of the supplemental molten metal 300 to narrow the head of ingot 106.

Figure 3C:
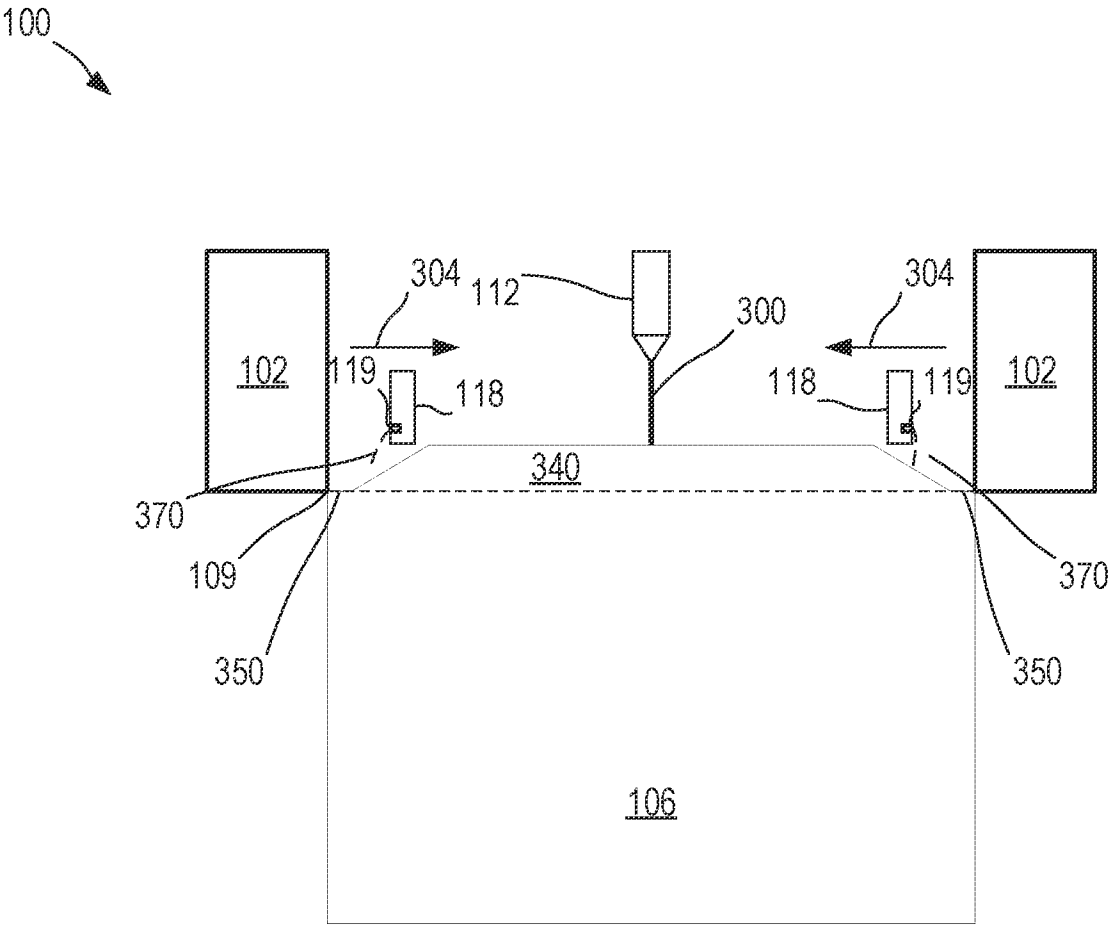

In FIG. 3C, chill bars 118 have been moved laterally inwardly toward the center of mold 102. For example, after the supplemental molten metal 300 has risen to a desired level to fill the reduced casting footprint of the head of the ingot 106, chill bars 118 may be actuated along direction 304 from their initial position into the narrowed position shown, such as under the influence of lateral actuator 210 (e.g., FIGS. 2A and 2B) or other suitable device. As chill bars 118 move, the mold 102 remains stationary. Thus, the bounds of the casting footprint are changed to an area constrained by the chill bars 118, rather than the mold 102. In bounding the casting footprint, a ledge 350 may be formed separating a sidewall of the ingot 106 and where the angling of the ingot head begins. The ledge 350 may, in some embodiments, correspond to the lateral thickness of the chill bars 118. In some embodiments, the ledge 350 may not be present on the ingot 106. Ingot 106 may be lowered and/or chill bars 118 may be raised upwards to define further space above the ingot 106 and/or along the top of the ingot 106 for supplemental molten metal 300 to be received. Due to the reduced casting footprint defined by the chill bars 118, the head of the ingot 106 is narrower in shape than the rest of the ingot 106 that was cast before the chill bars 118 were lowered into the lowered position and moved laterally inward within the mold 102. The dotted line across the ingot 106 in FIG. 3C indicates the width or depth or other corresponding dimension of the ingot 106 before the chill bars 118 were moved laterally inwardly along direction 304 to a narrower position. For example, the head 340 of the ingot 106 in FIG. 3C has a lower portion (e.g., the dotted line across the ingot 106 in FIG. 3C) that is wider than an upper portion (e.g., depicted in solid line).

Additional supplemental molten metal 300 may continue to flow into the mold 102 and increase the height of head 340 of the ingot 106. As chill bars 118 move further laterally inwardly (e.g., along direction 304), the chill bars 118 can continue to further reduce the casting footprint of ingot head 340.

The coolant jet 119 can be activated as the chill bars 118 are moved laterally inward. Activating the coolant jet 119 may provide a water stream 370 directed away from the center of the ingot 106. As the coolant jet 119 disperses water stream 370 away from the center of the ingot on to the head of the forming ingot 106, additional heat is extracted from the forming shell of the ingot 106. The dispersion of water stream 370 may cool and prevent breakage of the forming shell. The heat extraction caused by the water stream 370 may additionally prevent or mitigate undesired imperfections in the forming ingot, such as bleedout, freezeback, and other problems that may be possible as the shell cools. In some embodiments, the water streams 370 can be directed to avoid unwanted splash back from the water contacting the surface of the shell.

Figure 3D:
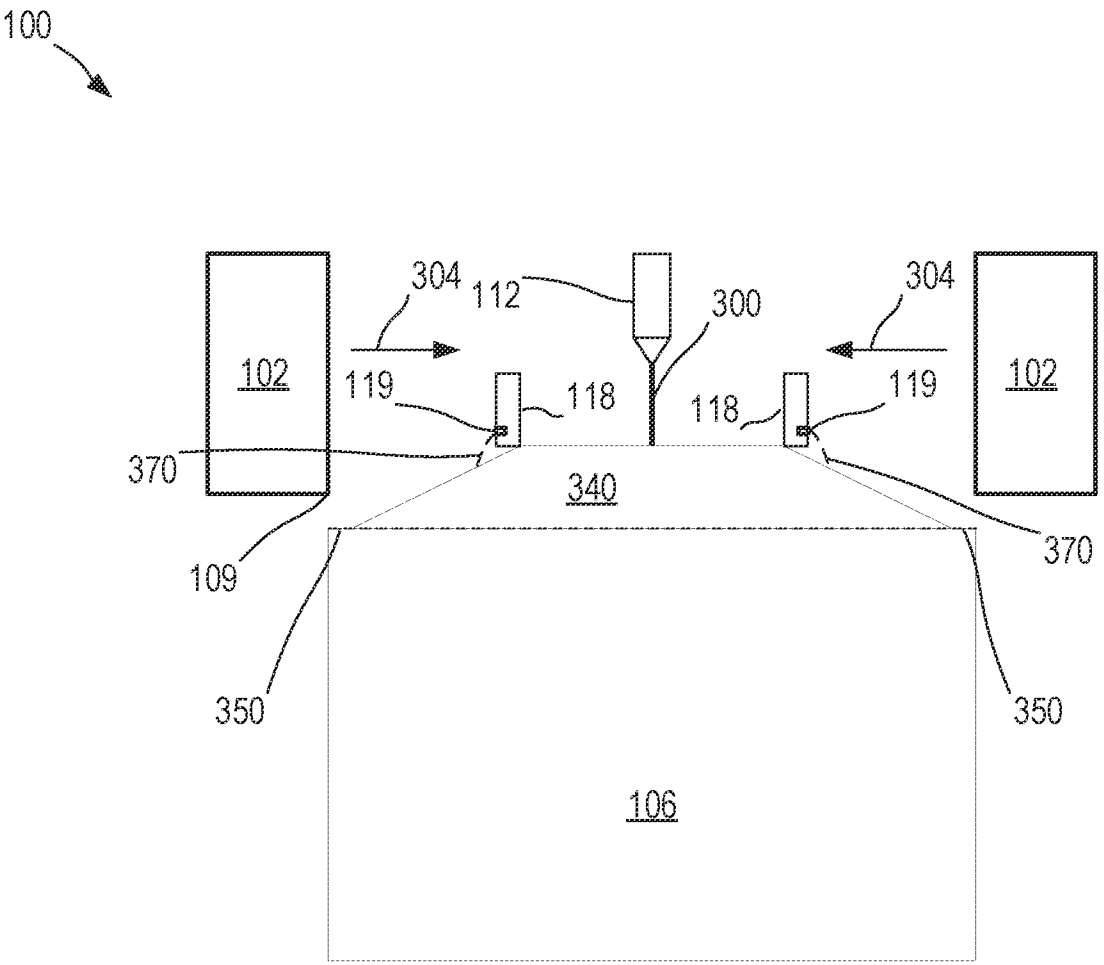

FIG. 3D shows a subsequent stage in the progression of chill bars 118 as they continue to move along direction 304 to control the shape of ingot head 340 by reducing the casting footprint. The coolant jets 119 may be moved laterally inward with the chill bars 118. In some embodiments, ingot head 340 may have a trapezoidal cross section or otherwise be tapered as desired. Concurrently, the ingot 106 can continue to move lower relative to the chill bars 118 by lowering movable bottom 104 (e.g., FIG. 1), or raising of the chill bars 118, or otherwise. Ingot head 340 can continue to taper as the chill bars 118 continue to reduce the casting footprint. The coolant jets 119 can change the angle of the water stream 370 to adjust for the change in position of the chill bars 118.

Figure 3E:
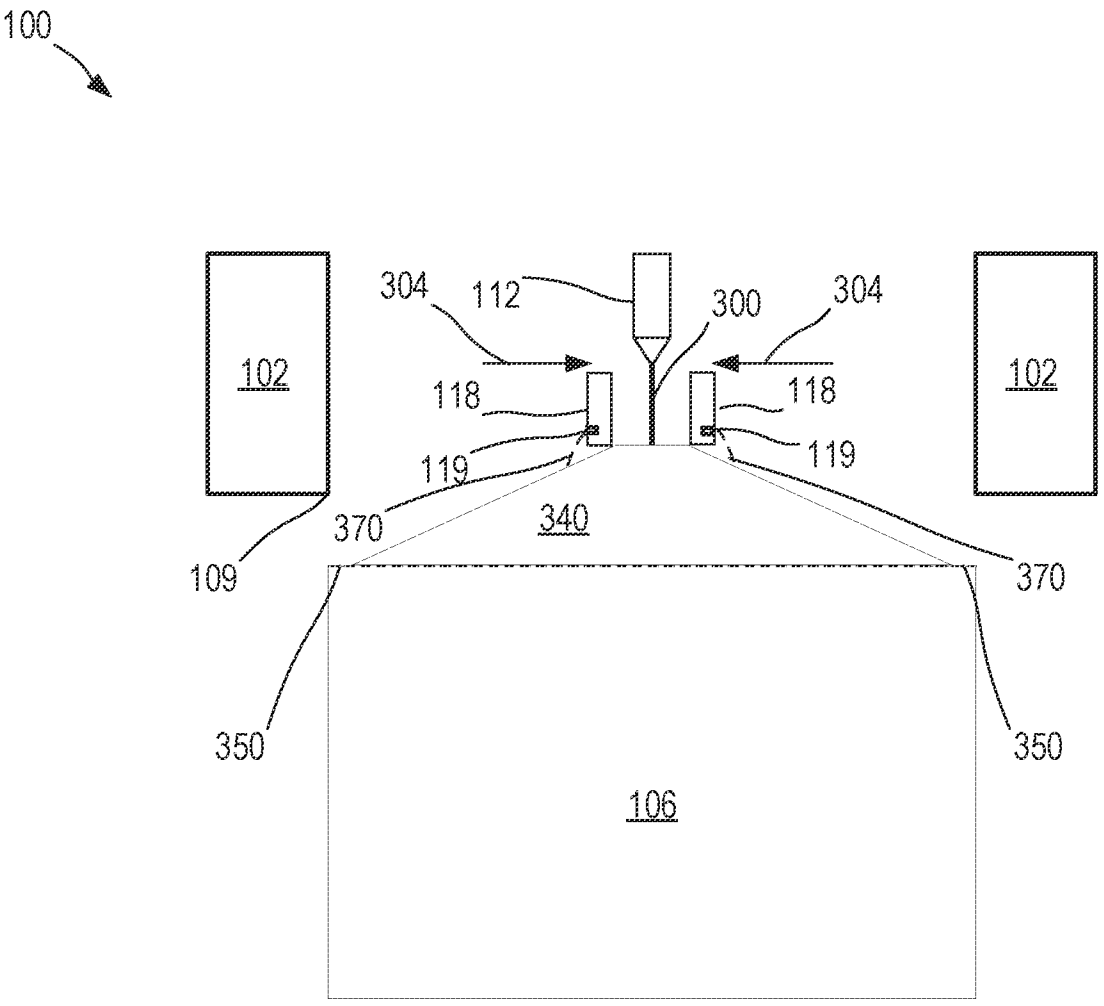

FIG. 3E shows a final position of system 100, according to embodiments. The chill bars 118 may continue to move in lateral direction 304 and cool supplemental molten metal 300 until they reach a final position as the supplemental molten metal 300 is fed into the reduced casting footprint bounded by chill bars 118. In some embodiments, the coolant jets 119 can continue to flow water on to the forming shell after the chill bars 118 have ceased moving laterally inwards. In some embodiments, the coolant jets 119 can cease flowing water before, after, or when the chill bars 118 cease moving laterally inwards. The reduced casting footprint formed by the movement of chill bars 118 allows for a lesser amount of molten metal to be cooling relative to the initial casting footprint as the ingot 106 fully solidifies. The lesser amount of molten metal cooling may reduce an amount of internal stress, which may prevent a shrinkage cavity from forming or may otherwise mitigate associated problems. Moreover, a tapered shape (such as the one shown in the embodiment of FIGS. 3A-3E, for example) of the head of the ingot may provide cost benefits by reducing loss in material that might otherwise be encountered by direct chill casting without any reduction relative to the initial casting footprint. Utilizing the ingot 106 with an ingot head 340 produced by the reduced casting footprint may improve efficiency with downstream metal processing systems, such as, for example, rolling of the ingot.

Figure 4A:
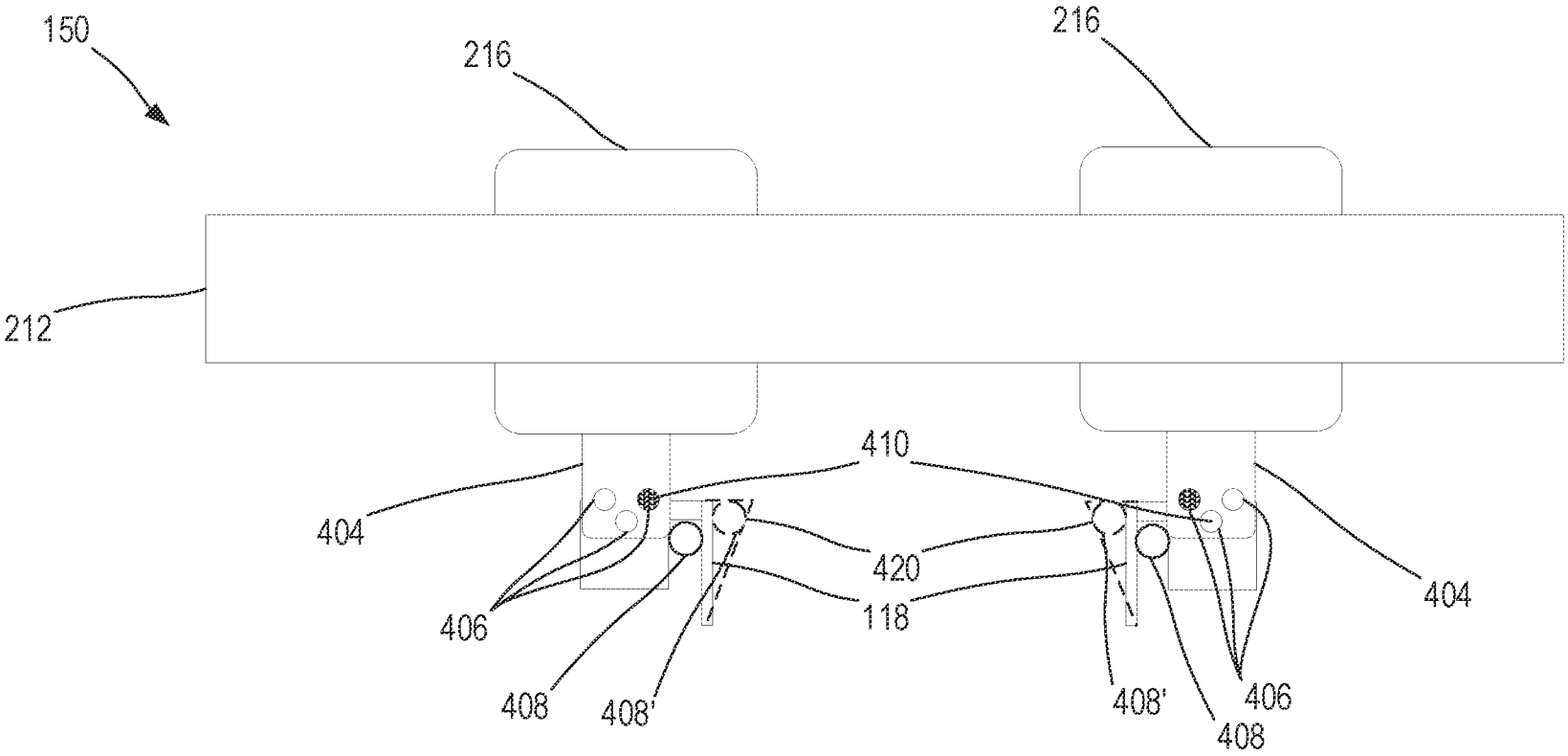
FIG. 4A is an end view of an example of a chill bar assembly, according to various embodiments.
Figure 4B:
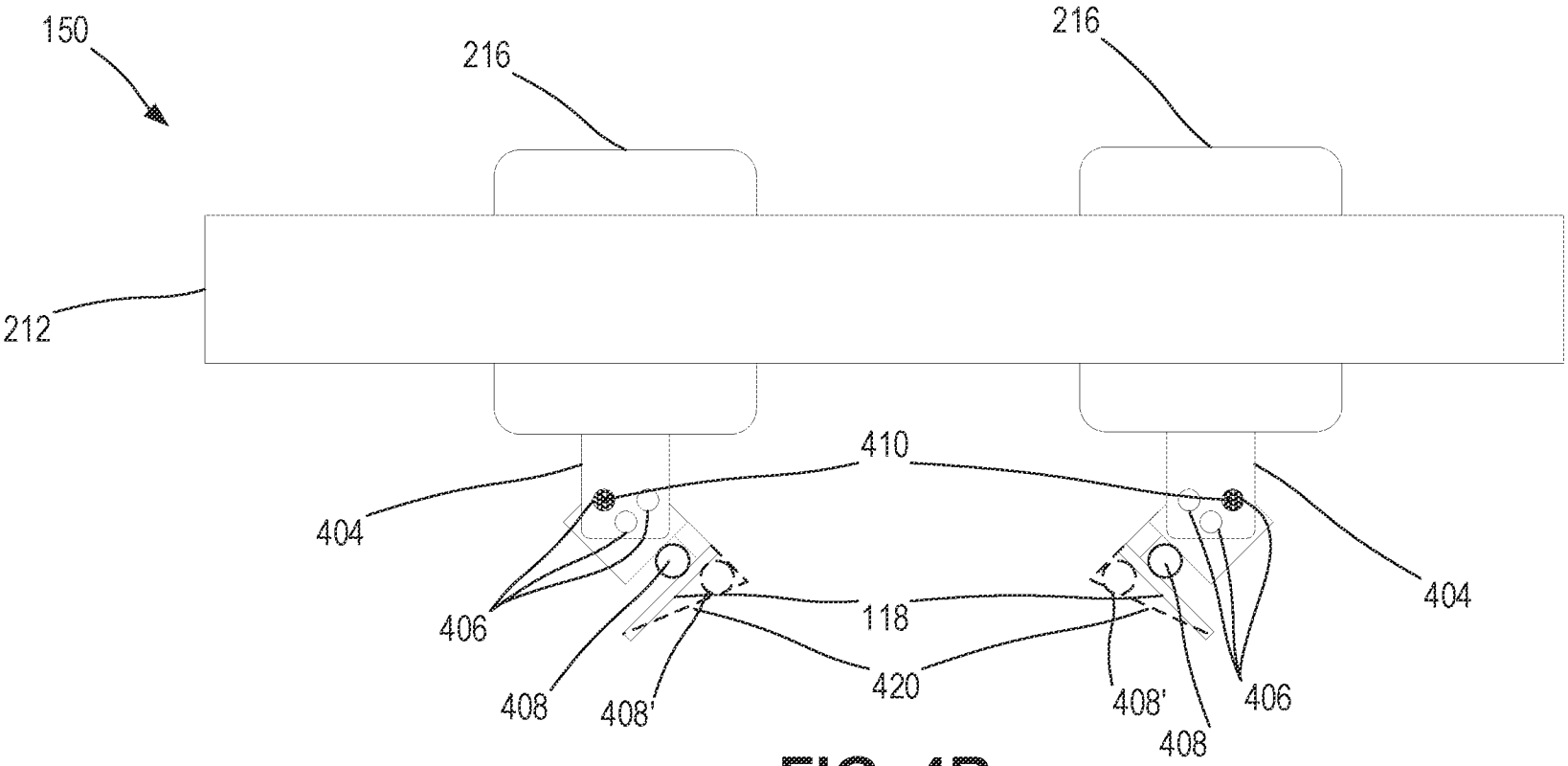
FIG. 4B is an end view of a chill bar assembly having elements arranged in an angled orientation, according to various embodiments.

FIGS. 4A through 4B show an example of chill bar assembly 150 that features an angle adjustment base 404 for the chill bars 118, according to embodiments. Chill bar assembly 150 of FIGS. 4A and 4B can be the same as the chill bar assemblies in FIG. 1 or 2A and 2B, although it need not be. Chill bar assembly 150 as illustrated in FIGS. 4A-4B includes an angle adjustment base 404, an adjustment control 406, a fastener 410, and a coolant conduit 408, which can be suitable to carry a coolant, such as water, glycerol, oil, or other suitable coolant.

According to embodiments, chill bars 118 can be angled in various positions by angle adjustment base 404. The chill bars 118 may be angled at various positions in a downwardly facing orientation, which may alter the amount of contact area with molten metal 110. For example, chill bars 118 may have a range of angles that may be movable from vertical (e.g., such that a bottom region of chill bar 118 is contacting molten metal 110), to horizontal (e.g., such that the entire face of chill bar 118 is contacting molten metal 110), or among other angles in between or among other ranges. Chill bars 118 can be secured in the angled position by adjustment control 406. Alternatively, adjustment control 406 may be a slot, opening, notches, or any other structure for obtaining desired angles of chill bar 118.

A fastener 410 interacts with adjustment control 406 to secure chill bars 118 in an angled position in FIG. 4A. In embodiments, it may be desirable to move the chill bars 118 in a lateral direction at such an angled position. Alternatively, fastener 410 can be a fastening screw, control pin, opening, slot, or any other feature for locking chill bar 118 in place. In other embodiments, the angle adjustment base 404 may be a dynamic adjustment mechanism, such that the contact angle of chill bars 118 adjusts as they move in a lateral direction throughout the cast. A dynamic adjustment mechanism may be accomplished by a movable pin controlled by a computer, guide slots, a rotary actuator or otherwise.

Coolant conduit 408 is visible in the view of FIG. 4A. Although coolant conduit 408 is depicted as a pipe adjacent to and external to the chill bars 118, coolant conduit 408 may take other forms suitable to convey coolant behind, within, or along chill bars 118 to transfer heat away from chill bars 118. Heat transfer away from chill bars 118 may allow for a constant rate of cooling (or other ongoing controllable rate of cooling) as new coolant is supplied through coolant conduit 408. In some embodiments, coolant conduit 408 may be, for example, a hollow area within the chill bar, flow chambers, or otherwise.

FIG. 4A is an end view of chill bars 118 showing them in a vertical orientation. In such an orientation, the angle of the chill bars 118 may contact molten metal, such as molten metal 110, with an upright face.

FIG. 4B is an end view of chill bars 118 at a fastened, fixed angle, according to embodiments. For example, in comparison to chill bars 118 of FIG. 4A that are in a generally vertical orientation, chill bars 118 of FIG. 4B are in an angled orientation. Such an orientation may increase an amount of surface area over which chill bars 118 make contact with the molten metal and/or may facilitate obtaining a desired ingot head shape. The angle adjustment base 404 may facilitate movement between extremes of different angles of orientation of chill bar 118. For example, fastener 410 in FIG. 4A is shown engaged in a different adjustment control 406 than in FIG. 4B. Although three finite or discrete positions are depicted in FIGS. 4A and 4B, any number and/or arrangement may be used to provide a suitable set or range of orientations and may include arrangements in which any orientation may be selected and secured between endpoints instead of being limited to discrete positions.

While FIGS. 4A and 4B in solid lines show the chill bar 118 as a flat planar rectangular shape, in some embodiments, the chill bar 118 can have, for example, a triangular shape, as indicated by the dashed lines 420. The triangular shape may provide an internal volume suitable for inclusion of the conduit 408, such as graphically depicted in dashed lines at 408'. Additionally or alternatively, the triangular shape may provide an initial tilt for the surface of the chill bar 118 and reduce an amount of adjustment to reach a desired angular orientation, for example.

The triangular shape may additionally or alternatively introduce a suitable shaping angle and reduce or eliminate a gap that might otherwise be introduced without the triangular shape. For example, with reference to FIG. 7, if a chill bar 720 initially having a rectangular cross section is bent into a curved profile to conform to the contour of a mold wall 740, subsequently rotating the bent rectangular bar to introduce an angle for shaping the ingot head may position different parts of a curve 750 at different heights relative to the molten metal level 710 in the mold and result in a gap 730 between the molten metal level 710 and the chill bar 720. Such a gap 730 may be reduced and/or eliminated by use of a triangular shape, e.g., which may provide a suitable shaping angle in a bent form without rotation. The triangular shape may incorporate an angle that is not locked at 90° to accommodate the bend, resulting in the bottom edge of the triangular shape resting on the surface of the molten metal. In some embodiments, the chill bar 118 can have other non-planar shapes, such as a curved face or any other suitable face for controlling the shape of an ingot head.

Figure 5:
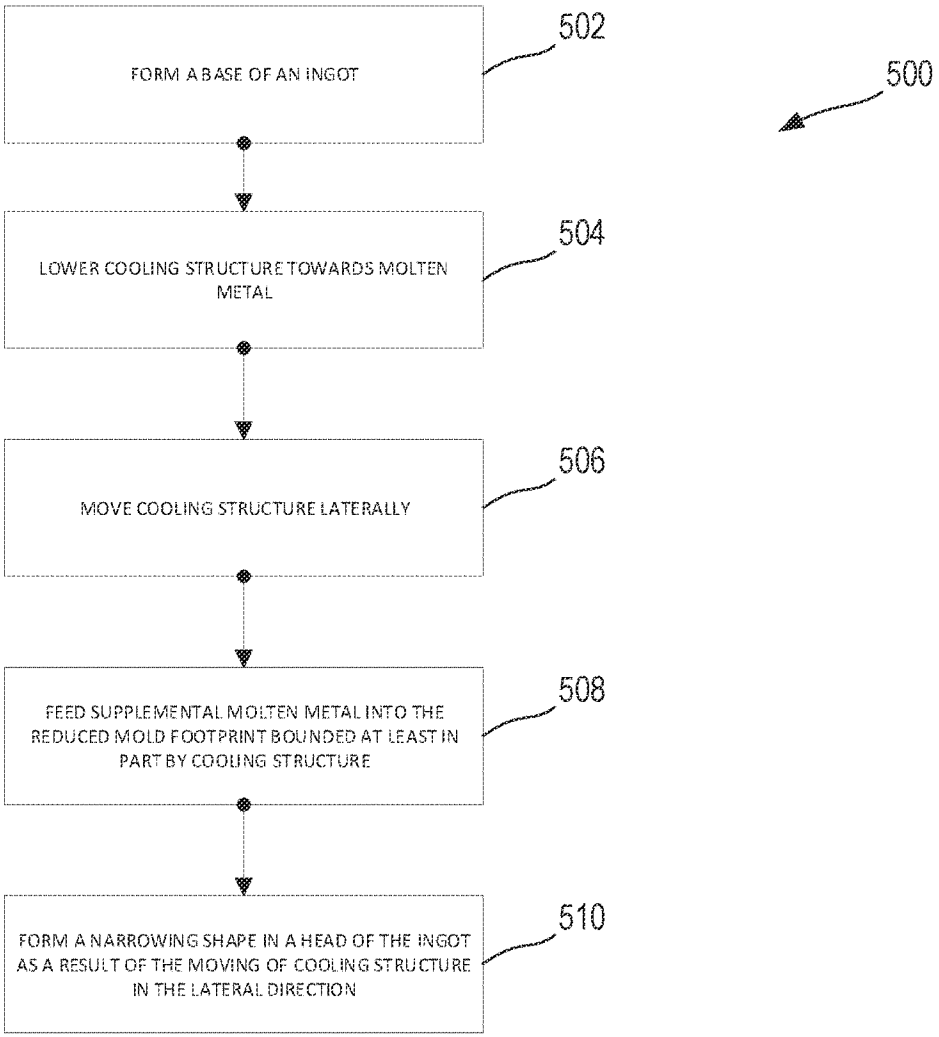
FIG. 5 is a flowchart illustrating a process of processing an ingot, according to various embodiments.

FIG. 5 is a flowchart of a process 500 according to embodiments. In operation 502, a base of an ingot, such as ingot 106 described above, is formed. The formation of the base of the ingot 106 may be accomplished at least partially by feeding molten metal, such as molten metal 110, into a mold, such as mold 102. The formation additionally may be accomplished at least partially by lowering a movable bottom, such as movable bottom 104, to increase the height of the ingot. For example, the movable bottom may be lowered simultaneously with the feeding of the molten metal. The movable bottom may continue lowering until a desired ingot body height is reached.

In operation 504, at least one cooling structure, such as chill bar 118, is lowered from a raised position in the vertical direction towards the molten metal into a lowered position. Such lowering may bring the chill bar within the mold and into contact with the molten metal. The chill bar may be lowered by an actuator, such as vertical actuator 120. The chill bar may be cooled by a coolant flowing therethrough or alongside, for example, to facilitate solidifying or freezing molten metal that comes into contact with the chill bar. For example, the chill bar may be coupled with or include coolant conduit 408. In embodiments, the chill bars may be angled (e.g., to increase the surface area contacting the molten metal) and/or capable of angle adjustment, such as discussed with respect to FIG. 4B.

In operation 506, the chill bar, such as chill bar 118, is moved in a lateral direction (such as lateral direction 116 or 304) inwardly toward the center of the mold. For example, the chill bar 118 may move along a top plane of the molten metal. The lateral movement of the chill bar 118 may create a reduced casting footprint bounded in part by the chill bar, such as the reduced casting footprint of ingot head 340. The chill bar may be moved in a horizontal direction by a lateral actuator, such as lateral actuator 210.

In operation 508, supplemental molten metal, such as supplemental molten metal 300, is fed into the reduced casting footprint bounded at least in part by the chill bar. Supplemental molten metal may be fed until a desired peak is reached. Relevant levels of the supplemental molten metal may be measured by a metal level sensor, such as metal level sensor 113.

In operation 510, a narrower portion of the head of the ingot is formed, such as ingot head 340. The narrowed shape of the ingot head results from the reduced casting footprint created by moving the chill bar inwardly in a horizontal direction and adding supplemental molten metal to fill the reduced casting footprint. The narrowing shape may be tapered with a trapezoidal cross-section, such as depicted with ingot head 340 in FIG. 3E. Relative to an ingot formed with the initial casting footprint, the narrowing shape may have less molten metal cooling as a result of the reduced casting footprint, e.g., reducing the internal stresses from the molten metal contracting as it solidifies. The narrowing shape may reduce or prevent a shrinkage cavity at the head of the ingot. The narrowing shape may be particularly suitable for metal processing, such as in a rolling mill.

Figure 6:
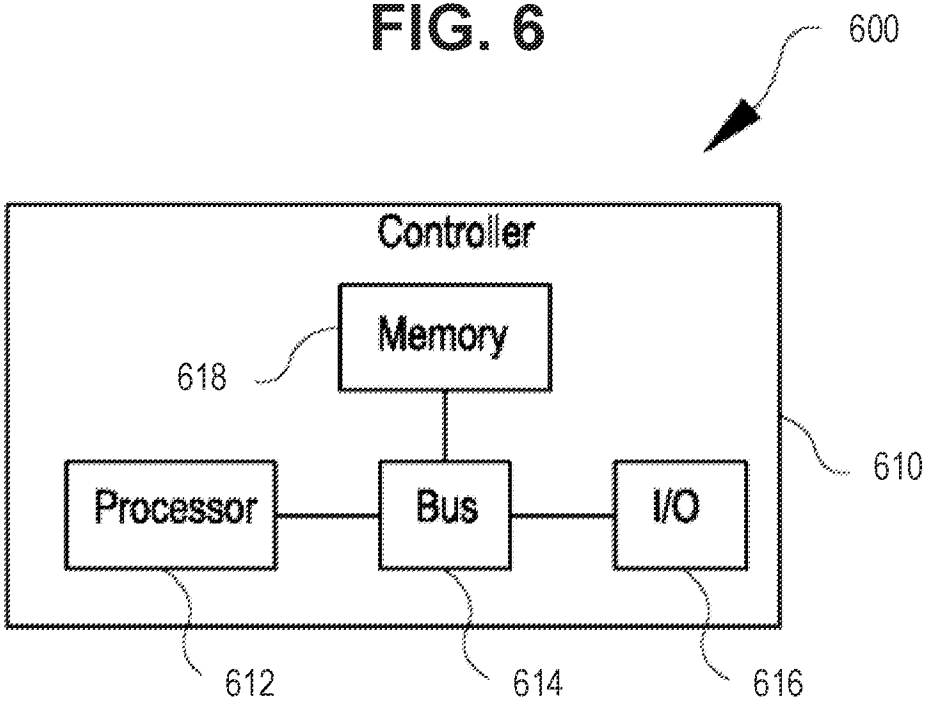
FIG. 6 is a simplified block diagram showing an example computer system for use with the system of FIG. 1, according to various embodiments.

FIG. 6 is a simplified block diagram showing an example computer system 600 for use with the system 100 for controlling the shape of an ingot 106, as shown in FIG. 1. In some embodiments, the computer system 600 performs one, some, or all of the steps of process 500. However, the computer system 600 may perform additional and/or alternative steps. In various embodiments, the computer system 600 includes a controller 610 that is implemented digitally and is programmable using conventional computer components. The controller 610 may be used in connection with certain examples (e.g., including equipment such as shown in FIG. 1) to carry out the processes of such examples. The controller 610 includes a processor 612 that can execute code stored on a tangible computer-readable medium in a memory 618 (or elsewhere such as portable media, on a server or in the cloud among other media) to cause the controller 610 to receive and process data and to perform actions and/or control components of equipment such as shown in FIG. 1. The controller 610 may be any device that can process data and execute code that is a set of instructions to perform actions such as to control industrial equipment. As non-limiting examples, the controller 610 can take the form of a digitally implemented and/or programmable PID controller, a programmable logic controller, a microprocessor, a server, a desktop or laptop personal computer, a laptop personal computer, a handheld computing device, and a mobile device.

Examples of the processor 612 include any desired processing circuitry, an application-specific integrated circuit (ASIC), programmable logic, a state machine, or other suitable circuitry. The processor 612 may include one processor or any number of processors. The processor 612 can access code stored in the memory 618 via a bus 614. The memory 618 may be any non-transitory computer-readable medium configured for tangibly embodying code and can include electronic, magnetic, or optical devices. Examples of the memory 618 include random access memory (RAM), read-only memory (ROM), flash memory, a floppy disk, compact disc, digital video device, magnetic disk, an ASIC, a configured processor, or other storage device.

Instructions can be stored in the memory 618 or in the processor 612 as executable code. The instructions can include processor-specific instructions generated by a compiler and/or an interpreter from code written in any suitable computer-programming language. The instructions can take the form of an application that includes a series of setpoints, various angles of the chill bar, incremental steps to move the chill bar, and/or other programmed operations which, when executed by the processor 612, allow the controller 610 to control the shape of the ingot head 340 by actuating, moving, and/or otherwise controlling elements of the system of FIG. 1.

The controller 610 shown in FIG. 6 includes an input/output (I/O) interface 616 through which the controller 610 can communicate with devices and systems external to the controller 610, including components such as the molten metal source 112, vertical actuator 120, lateral actuator 210, or any related sensors or other components. The input/output (I/O) interface 616 can also, if desired, receive input data from other external sources. Such sources can include control panels, other human/machine interfaces, computers, servers or other equipment that can, for example, send instructions and parameters to the controller 610 to control its performance and operation; store and facilitate programming of applications that allow the controller 610 to execute instructions in those applications to control the shape of ingot head 340, such as in connection with the processes of certain examples of this disclosure; and other sources of data necessary or useful for the controller 610 in carrying out its functions. Such data can be communicated to the input/output (I/O) interface 616 via a network, hardwire, wirelessly, via bus, or as otherwise desired.

Although specific embodiments of the disclosure have been described, various modifications, alterations, alternative constructions, and equivalents are also encompassed within the scope of the disclosure. Embodiments of the present disclosure are not restricted to operation within certain specific environments, but are free to operate within a plurality of environments. Additionally, although method embodiments of the present disclosure have been described using a particular series of operations and steps, it should be apparent to those skilled in the art that the scope of the present disclosure is not limited to the described series of operations and steps.

The specification and drawings are, accordingly, to be regarded in an illustrative rather than a restrictive sense. It will, however, be evident that additions, subtractions, deletions, and other modifications and changes may be made thereunto without departing from the broader spirit and scope.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. As used herein, the meaning of "a," "an," and "the" includes singular and plural references unless the context clearly dictates otherwise.

The following example will serve to further illustrate the present invention without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention. During the studies described in the following example, conventional procedures were followed, unless otherwise stated.

Example 1

A copper chill bar with a triangular cross-section was used to evaluate the ability to control the shape of an ingot head. The triangular cross-section allowed the chill bar to be bent to conform to the mold profile being used. For ease of observation, the chill bar was placed on one side of the mold without a second chill bar on the opposite side of the mold. The chill bar was formed of a copper tube 3/32" thick. The chill bar was initially positioned with its center approximately 37 mm up from the tang, and with its ends about 5 mm lower. In said position, a lower edge of the chill bar was submerged approximately 35 mm into the surface of the molten metal, while an upper portion of the chill bar stood proud above the surface of the molten metal.

The cast speed was run at 60 mm/min. When the ingot reached a depth of 1000 mm, the copper chill bar commenced moving. The chill bar descended 33 mm and subsequently began moving laterally inward for shaping the head of the ingot. A substantially horizontal ledge was initially observed on the ingot, corresponding to a height on the ingot where the chill bar was initially vertically introduced. Angling of the ingot head away from the ledge was readily apparent at 15 seconds after water from the mold began flowing across the ledge. The casting speed of the ingot body was maintained as the head of the ingot was cast and the chill bar moved inwards laterally. The cast ceased at a 1087 mm depth. From the resulting ingot, it was apparent that the ingot head was able to be angled. The angle was approximately 64° from horizontal in the head of the completed ingot.

In a second test, the same setup with triangular cross-section chill bar was used. The cast speed was lowered to 30 mm/min. When the ingot reached a depth of 1000 mm, the copper chill bar commenced moving. The chill bar descended 33 mm. A time delay was reduced between the chill bar lowering and the chill bar moving laterally inward, relative to the first cast. A substantially horizontal ledge was initially observed on the ingot, corresponding to a height on the ingot where the chill bar was initially vertically introduced. The casting speed of the ingot body was maintained as the head of the ingot was cast and the chill bar moved inwards laterally. The cast ceased at a 1189 mm depth. From the resulting ingot, it was apparent that the ingot head was able to be angled. The angle was approximately 53° from horizontal in the head of the completed ingot.

ILLUSTRATIONS

In some aspects, a device, a system, or a method is provided according to one or more of the following illustrations or according to some combination of the elements thereof. In some aspects, features of a device or a system described in one or more of these examples can be utilized within a method described in one of the other examples, or vice versa.

As used below, any reference to a series of illustrations is to be understood as a reference to each of those examples disjunctively (e.g., "Illustrations 1-4" is to be understood as "Illustrations 1, 2, 3, or 4").

Illustration 1 is a method of ingot formation, comprising: forming a base of the ingot by feeding molten metal into a mold that defines an initial casting footprint and by lowering a movable bottom relative to the mold to increase a height of the ingot; moving at least one cooling structure in a vertical direction from an initial position into contact with the molten metal; moving the at least one cooling structure in a horizontal direction along a top plane of the molten metal to produce a reduced casting footprint bounded at least in part by the at least one cooling structure, wherein the reduced casting footprint is smaller than the initial casting footprint; and, feeding supplemental molten metal into the reduced casting footprint to form a narrowing shape in a head of the ingot.

Illustration 2 is the method of any of the preceding or subsequent illustrations wherein the cooling structure comprises a chill bar.

Illustration 3 is the method of any of the preceding or subsequent illustrations wherein the chill bar has a triangular cross-section.

Illustration 4 is the method of any of the preceding or subsequent illustrations wherein the molten metal comprises an aluminum alloy.

Illustration 5 is the method of any of the preceding or subsequent illustrations further comprising: permitting solidification of a first region of the molten metal adjacent a first position of the at least one cooling structure relative to the head of the ingot; moving the at least one cooling structure in the horizontal direction along the top plane of the molten metal to a second position relative to the head of the ingot; and, permitting solidification of a second region of the molten metal adjacent the second position of the at least one cooling structure relative to the head of the ingot.

Illustration 6 is the method of any of the preceding or subsequent illustrations further comprising: permitting solidification of the molten metal; and subsequent to the solidification of the molten metal, at least one of: moving the at least one cooling structure in the horizontal direction along the top plane of the molten metal; lowering the movable bottom; or raising the at least one cooling structure in the vertical direction.

Illustration 7 is the method of any of the preceding or subsequent illustrations, wherein the moving of the at least one cooling structure is performed by at least one servo motor.

Illustration 8 is the method of any of the preceding or subsequent illustrations, further comprising changing an angle of the at least one cooling structure relative to the horizontal direction.

Illustration 9 is the method of any of the preceding or subsequent illustrations, wherein the changing an angle of the at least one cooling structure occurs concurrently with the moving the at least one chill bar in the horizontal direction.

Illustration 10 is the method of any of the preceding or subsequent illustrations, wherein the at least one cooling structure has an angle relative to the horizontal direction, and the angle relative to the horizontal direction remains fixed while the at least one cooling structure is moving in the horizontal direction.

Illustration 11 is the method of any of the preceding or subsequent illustrations, further comprising routing a coolant through the at least one cooling structure.

Illustration 12 is the method of any of the preceding or subsequent illustrations, wherein the moving the at least one cooling structure in the horizontal direction occurs concurrently with the lowering of the movable bottom.

Illustration 13 is the method of any of the preceding or subsequent illustrations, wherein the moving the at least one cooling structure in the vertical direction from the initial position into contact with the molten metal comprises lowering the at least one cooling structure into a lowered position adjacent the mold and in contact with the molten metal.

Illustration 14 is a system for ingot formation, comprising: a mold for receiving molten metal, the mold defining an initial casting footprint; a movable bottom, movable in a vertical direction relative to the mold; a nozzle positioned for feeding molten metal into the mold; and, at least one cooling assembly, the at least one cooling assembly comprising: at least one cooling structure; and an actuator coupled with the at least one cooling structure and operable to move the cooling structure in a lateral direction relative to the mold so as to define a reduced casting footprint bounded at least in part by the at least one cooling structure and smaller than the initial casting footprint.

Illustration 15 is the system of any of the preceding or subsequent illustrations, wherein the at least one cooling assembly is a chill bar assembly.

Illustration 16 is the system of any of the preceding or subsequent illustrations, wherein the at least one cooling structure comprises a chill bar.

Illustration 17 is the system of any of the preceding or subsequent illustrations, wherein the chill bar has a triangular cross-section.

Illustration 18 is the system of any of the preceding or subsequent illustrations, wherein the at least one cooling structure is positioned at an angle relative to the lateral direction.

Illustration 19 is the system of any of the preceding or subsequent illustrations, wherein the angle of the at least one cooling structure is adjustable.

Illustration 20 is the system of any of the preceding or subsequent illustrations, wherein the actuator comprises a servo motor and a ball screw.

Illustration 21 is the system of any of the preceding or subsequent illustrations, wherein the at least one cooling structure comprises at least two cooling structures, and wherein the actuator is operable to move the at least two cooling structures in the lateral direction.

Illustration 22 is the system of any of the preceding or subsequent illustrations, wherein the at least one cooling structure is further movable in the vertical direction from an initial position into a lowered position within the mold.

Illustration 23 is a chill bar assembly, comprising: a chill bar configured to move in a vertical direction to engage a molten metal surface; a coolant conduit positioned adjacent the chill bar for conveying heat away from the chill bar when coolant is conveyed through the coolant conduit; and, an angle adjustment base, wherein the angle adjustment base is mechanically coupled to the chill bar and configured to selectively orient the chill bar among a plurality of predetermined angles relative to a horizontal direction.

Illustration 24 is the assembly of any of the preceding or subsequent illustrations, wherein the angle adjustment base is lockable to secure the chill bar at a fixed angle.

Illustration 25 is the assembly of any of the preceding or subsequent illustrations, wherein the angle adjustment base has one or more openings arranged to engage or receive a fastener to set the angle of the chill bar.

Illustration 26 is the assembly of any of the preceding or subsequent illustrations, wherein the chill bar is configured to move in a horizontal direction within a mold in contact with the molten metal surface.

Illustration 27 is the assembly of any of the preceding or subsequent illustrations, wherein the chill bar has a triangular cross-section.

All patents, publications and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method of ingot formation, the method comprising:

forming a base of an ingot by feeding molten metal into a mold that defines an initial casting footprint and by lowering a movable bottom relative to the mold to increase a height of the ingot;

moving at least one cooling structure at least in a vertical direction from an initial position into contact with the molten metal, wherein the at least one cooling structure is movable independent of the mold;

moving the at least one cooling structure at least in a horizontal direction within the initial casting footprint and along a top plane of the molten metal to produce a reduced casting footprint bounded at least in part by the at least one cooling structure, wherein the reduced casting footprint is smaller than the initial casting footprint; and feeding supplemental molten metal into the reduced casting footprint to form a narrowing shape in a head of the ingot.

2. The method of claim 1, wherein the molten metal comprises an aluminum alloy.

3. The method of claim 1 further comprising:

permitting solidification of a first region of the molten metal adjacent a first position of the at least one cooling structure relative to the head of the ingot;

moving the at least one cooling structure at least in the horizontal direction along the top plane of the molten metal to a second position relative to the head of the ingot; and, permitting solidification of a second region of the molten metal adjacent the second position of the at least one cooling structure relative to the head of the ingot.

4. The method of claim 1, further comprising:

permitting solidification of the molten metal; and subsequent to the solidification of the molten metal, at least one of:

moving the at least one cooling structure at least in the horizontal direction along the top plane of the molten metal;

lowering the movable bottom; or raising the at least one cooling structure in the vertical direction.

5. The method of claim 1, wherein the moving of the at least one cooling structure is performed by at least one servo motor.

6. The method of claim 1, further comprising changing an angle of the at least one cooling structure relative to the horizontal direction.

7. The method of claim 6, wherein the changing the angle of the at least one cooling structure occurs concurrently with the moving the at least one cooling structure at least in the horizontal direction.

8. The method of claim 1, wherein the at least one cooling structure has an angle relative to the horizontal direction, and the angle relative to the horizontal direction remains fixed while the at least one cooling structure is moving at least in the horizontal direction.

9. The method of claim 1, further comprising routing a coolant through the at least one cooling structure.

10. The method of claim 1, wherein the moving the at least one cooling structure at least in the horizontal direction occurs concurrently with the lowering of the movable bottom.

11. The method of claim 1, wherein the moving the at least one cooling structure at least in the vertical direction from the initial position into contact with the molten metal comprises lowering the at least one cooling structure into a lowered position adjacent the mold and in contact with the molten metal.

12. A system for ingot formation, the system comprising:
- a mold for receiving molten metal, the mold defining an initial casting footprint;
- a movable bottom, movable in a vertical direction relative to the mold;
- a nozzle positioned for feeding molten metal into the mold; and,
- at least one cooling assembly, the at least one cooling assembly comprising:
  - at least one cooling structure movable independent of the mold, the at least one cooling structure movable at least in the vertical direction from an initial position into a lowered position in which the at least one cooling structure is within the initial casting footprint defined by the mold and along a top plane of the molten metal; and
  - an actuator coupled with the at least one cooling structure and operable to move the at least one cooling structure within the initial casting footprint and between sides of the mold at least in a lateral direction along the top plane of the molten metal so as to define a reduced casting footprint bounded at least in part by the at least one cooling structure and smaller than the initial casting footprint.

13. The system of claim 12, wherein the at least one cooling assembly is a chill bar assembly, and wherein the at least one cooling structure comprises a chill bar.

14. The system of claim 13, wherein the chill bar has a triangular cross-section.

15. The system of claim 12, wherein the at least one cooling structure is positioned at an angle relative to the lateral direction.

16. The system of claim 15, wherein the angle of the at least one cooling structure is adjustable.

17. The system of claim 12, wherein the actuator comprises a servo motor and a ball screw.

18. The system of claim 12, wherein the at least one cooling structure comprises at least two cooling structures, and wherein the actuator is operable to move the at least two cooling structures in the lateral direction.

19. The system of claim 12, wherein the at least one cooling structure includes a chill bar assembly comprising:
- a chill bar configured to move at least in the vertical direction to engage a molten metal surface;
- a coolant conduit positioned adjacent the chill bar for conveying heat away from the chill bar when coolant is conveyed through the coolant conduit; and,
- an angle adjustment base, wherein the angle adjustment base is mechanically coupled to the chill bar and configured to selectively orient the chill bar among a plurality of predetermined angles relative to a horizontal direction.

20. The system of claim 19, wherein the angle adjustment base is lockable to secure the chill bar at a fixed angle.

21. The system of claim 19, wherein the angle adjustment base has one or more openings arranged to engage or receive a fastener to set an angle of the chill bar.

22. The system of claim 19, wherein the chill bar is configured to move at least in the horizontal direction within the initial casting footprint of the mold, in contact with the molten metal surface.

* * * * *